US009526296B2

(12) United States Patent
Langvin et al.

(10) Patent No.: US 9,526,296 B2
(45) Date of Patent: Dec. 27, 2016

(54) ARTICLE OF FOOTWEAR FOR ATHLETIC AND RECREATIONAL ACTIVITIES

(71) Applicant: NIKE, Inc., Beaverton, OR (US)

(72) Inventors: Elizabeth Langvin, Sherwood, OR (US); Bryant Russell Klug, Beaverton, OR (US); Nadia M. Panian, Beaverton, OR (US); Nathan G. Schultze, Portland, OR (US); Matthew C. Palmer, Portland, OR (US); Kevin J. Rucier, Portland, OR (US); Tobie D. Hatfield, Lake Oswego, OR (US); Thomas J. Rushbrook, Portland, OR (US); Aaron K. Seid, Portland, OR (US)

(73) Assignee: Nike, Inc., Beaverton, OR (US)

( * ) Notice: Subject to any disclaimer, the term of this patent is extended or adjusted under 35 U.S.C. 154(b) by 5 days.

(21) Appl. No.: 14/209,100

(22) Filed: Mar. 13, 2014

(65) Prior Publication Data

US 2015/0257475 A1 Sep. 17, 2015

(51) Int. Cl.

| | |
|---|---|
| ***A43B 3/00*** | (2006.01) |
| ***A43B 5/00*** | (2006.01) |
| ***A43B 23/02*** | (2006.01) |
| ***A43B 13/14*** | (2006.01) |
| ***A43B 7/20*** | (2006.01) |
| ***A43B 13/22*** | (2006.01) |
| ***A43B 13/38*** | (2006.01) |

(52) U.S. Cl.

CPC . *A43B 5/00* (2013.01); *A43B 7/20* (2013.01); *A43B 13/141* (2013.01); *A43B 13/223* (2013.01); *A43B 13/38* (2013.01); *A43B 23/021* (2013.01); *A43B 23/0205* (2013.01); *A43B 23/0215* (2013.01); *A43B 23/0235* (2013.01)

(58) Field of Classification Search

CPC ..... A43B 5/00; A43B 5/12; A43B 7/087; A43B 13/02; A43B 13/04; A43B 13/12; A43B 13/122; A43B 13/141; A43B 13/143; A43B 23/0205; A43B 23/0235; A43B 1/0027; A43B 1/009; A43B 3/0042; A43B 7/20; A43B 13/223; A43B 13/38; A43B 23/021; A43B 23/0215

USPC ..... 36/84, 113, 25 R, 102, 103, 114, 8.3, 45,36/50.1, 59 R, 59 C, 147; D2/953, 954, 955, D2/956, 969, 972

See application file for complete search history.

(56) References Cited

U.S. PATENT DOCUMENTS

| | | | | |
|---|---|---|---|---|
| 2,926,433 A | | 3/1960 | Kramer | |
| 4,027,406 A | | 6/1977 | Salvatore | |
| 4,517,753 A | * | 5/1985 | Rosenbaum et al. | 36/128 |
| 4,519,148 A | * | 5/1985 | Sisco | A43B 5/12 36/103 |
| 4,616,432 A | * | 10/1986 | Bunch et al. | 36/50.1 |

(Continued)

*Primary Examiner* — Anna Kinsaul
*Assistant Examiner* — Carolyn W Davis
(74) *Attorney, Agent, or Firm* — Gerard M. Wissing, Esq.; Wissing Miller LLP

(57) ABSTRACT

An article of footwear in which certain regions of the upper may be slippery, such that it is more difficult for a person to firmly grasp the article of footwear. The eyestays in the article of footwear are biased towards the lateral side of the footwear. The article of footwear also has an outer sole with ridges at, for example, the back of the heel, the ball-of-the foot regions on the lateral and medial sides, respectively, of the article of footwear, and at the toe region. The ridges are angled downward, such that the wearer of the footwear may have increased traction by digging the ridges into the ground or into a playing surface.

20 Claims, 16 Drawing Sheets

(56) References Cited

U.S. PATENT DOCUMENTS 4,899,470 A * 2/1990 Holland, III ..... 36/133
4,908,037 A 3/1990 Ross
D310,132 S * 8/1990 Hase ..... D2/949
5,117,568 A * 6/1992 Mitsui ..... A43B 23/26 36/114
5,345,638 A * 9/1994 Nishida ..... A41H 3/08 12/146 C
5,416,989 A * 5/1995 Preston ..... 36/108
D389,993 S * 2/1998 Ryan ..... D2/953
5,813,143 A * 9/1998 Bell et al. ..... 36/59 R
5,819,439 A * 10/1998 Sanchez ..... 36/89
5,827,210 A * 10/1998 Antar et al. ..... 602/23
D400,344 S * 11/1998 Avar ..... D2/954
6,684,411 B1 2/2004 Bachert et al.
6,922,917 B2 8/2005 Kerns et al.
D515,791 S * 2/2006 McClaskie ..... D2/951
D552,833 S * 10/2007 Yamashita et al. ..... D2/902
7,325,336 B2 2/2008 Yamashita et al.
7,337,558 B2 * 3/2008 Terlizzi ..... A43B 5/12 36/102
D571,995 S * 7/2008 Mochen ..... D2/969
7,685,740 B2 * 3/2010 Sokolowski ..... A43B 5/12 36/44
8,296,973 B2 * 10/2012 Roberti ..... A43B 3/24 36/113
8,356,425 B2 * 1/2013 Polegato Moretti ..... A43B 7/08 36/3 B
D676,642 S * 2/2013 Rasmussen ..... D2/972
D677,866 S * 3/2013 Vestuti ..... D2/947
D689,677 S * 9/2013 Bathum ..... D2/951
D697,704 S * 1/2014 Vestuti ..... D2/951
2002/0078599 A1 * 6/2002 Delgorgue ..... A43B 7/12 36/98
2003/0159314 A1 * 8/2003 Lewia ..... A43B 1/0081 36/130
2003/0167658 A1 * 9/2003 Davis ..... A43B 5/02 36/128
2003/0196354 A1 * 10/2003 Chu ..... A43B 5/003 36/113
2005/0108901 A1 * 5/2005 Yamashita ..... A43B 5/00 36/113
2008/0078102 A1 * 4/2008 Kilgore et al. ..... 36/50.1
2009/0188134 A1 * 7/2009 Polegato Moretti ... A43B 7/125 36/3 B
2010/0126041 A1 * 5/2010 Francis ..... A43B 17/023 36/91
2010/0154251 A1 * 6/2010 Nataadiningrat ..... A43B 5/12 36/8.3
2010/0299967 A1 * 12/2010 Atsumi ..... A43B 5/02 36/133
2012/0180340 A1 7/2012 Crowley, II et al.
2012/0216423 A1 * 8/2012 Lyden ..... A43B 1/0081 36/84

* cited by examiner

ARTICLE OF FOOTWEAR FOR ATHLETIC AND RECREATIONAL ACTIVITIES

CROSS-REFERENCE TO RELATED APPLICATIONS

This application is related to commonly owned application Ser. No. 14/209,151, now U.S. Pre-Grant Publication 2015/0257476, filed on Mar. 13, 2014, entitled "Article of Footwear for Athletic and Recreational Activities with Bootie", which Application is hereby incorporated by reference in its entirety.

BACKGROUND

The present embodiments relate generally to articles of footwear that may be used for contact sports such as wrestling.

Articles of footwear can generally be described as having two primary elements, an upper for enclosing the wearer's foot, and a sole structure attached to the upper. The upper generally extends over the toe and instep areas of the foot, along the medial and lateral sides of the foot and around the back of the heel. The sole structure may include an insole, a midsole, and an outsole. The insole is in close contact with the wearer's foot or sock, and provides a comfortable feel to the sole of the wearer's foot. The midsole generally attenuates impact or other stresses due to ground forces as the wearer is walking, running, jumping, or engaging in other activities. The outsole generally carries a tread pattern to ensure a firm contact with the ground or playing surface. For some activities, the outsole may also use cleats, spikes or other protrusions to engage the ground or playing surface and thus provide additional traction.

SUMMARY

This summary is intended to provide an overview of the subject matter of this patent, and is not intended to identify essential elements or key elements of the subject matter, nor is it intended to be used to determine the scope of the claimed embodiments. The proper scope of this patent may be ascertained from the claims set forth below in view of the detailed description below and the drawings.

In one aspect, an article of footwear has an upper and a sole attached to the upper, where the upper further includes a first portion made of a first material with a first surface that has a first coefficient of friction and a second portion made of a second material with a second surface that has a second coefficient of friction, where the second coefficient of friction is substantially greater than the first coefficient of friction. The upper also includes an eyestay region comprising a plurality of eyelets, where the eyestay region is substantially biased towards a lateral side of the article of footwear. The sole includes a textile material with a plurality of pads attached to the textile material, where the pads comprise downwardly-angled ridges at their outer edges.

In another aspect, an article of footwear includes a sole with a textile layer and a plurality of elastomeric pads and an upper made of a first material and a second material. The upper is attached to the sole. The second material is disposed at the periphery of the upper and is tacky compared to the first material. At least one of the plurality of elastomeric pads comprises ridges that are angled downwards. At least one of the plurality of elastomeric pads includes an aperture for allowing moisture generated within the article of footwear to escape through the textile layer.

In another aspect, a wrestling shoe includes an upper made of a first material and a second material, the second material being tacky compared to the first material. The shoe includes a sole with a textile strobel and a toe pad in a big toe region of the sole. The sole has a heel pad in a heel region of the sole. The coefficient of friction of the second material is greater by at least an order of magnitude compared to the coefficient of friction of the first material. The upper also comprises an eyestay region biased towards the lateral side of the upper. The toe pad has a plurality of downwardly-angled ridges and the heel pad has a plurality of downwardly-angled ridges.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

For clarity, the detailed descriptions herein describe certain exemplary embodiments, but the disclosure in this application may be applied to any article of footwear comprising certain features described herein and recited in the claims. In particular, although the following detailed description describes exemplary embodiments in the form of wrestling shoes, it should be understood that the other embodiments may take the form of other articles of athletic or recreational footwear.

Figure 1:
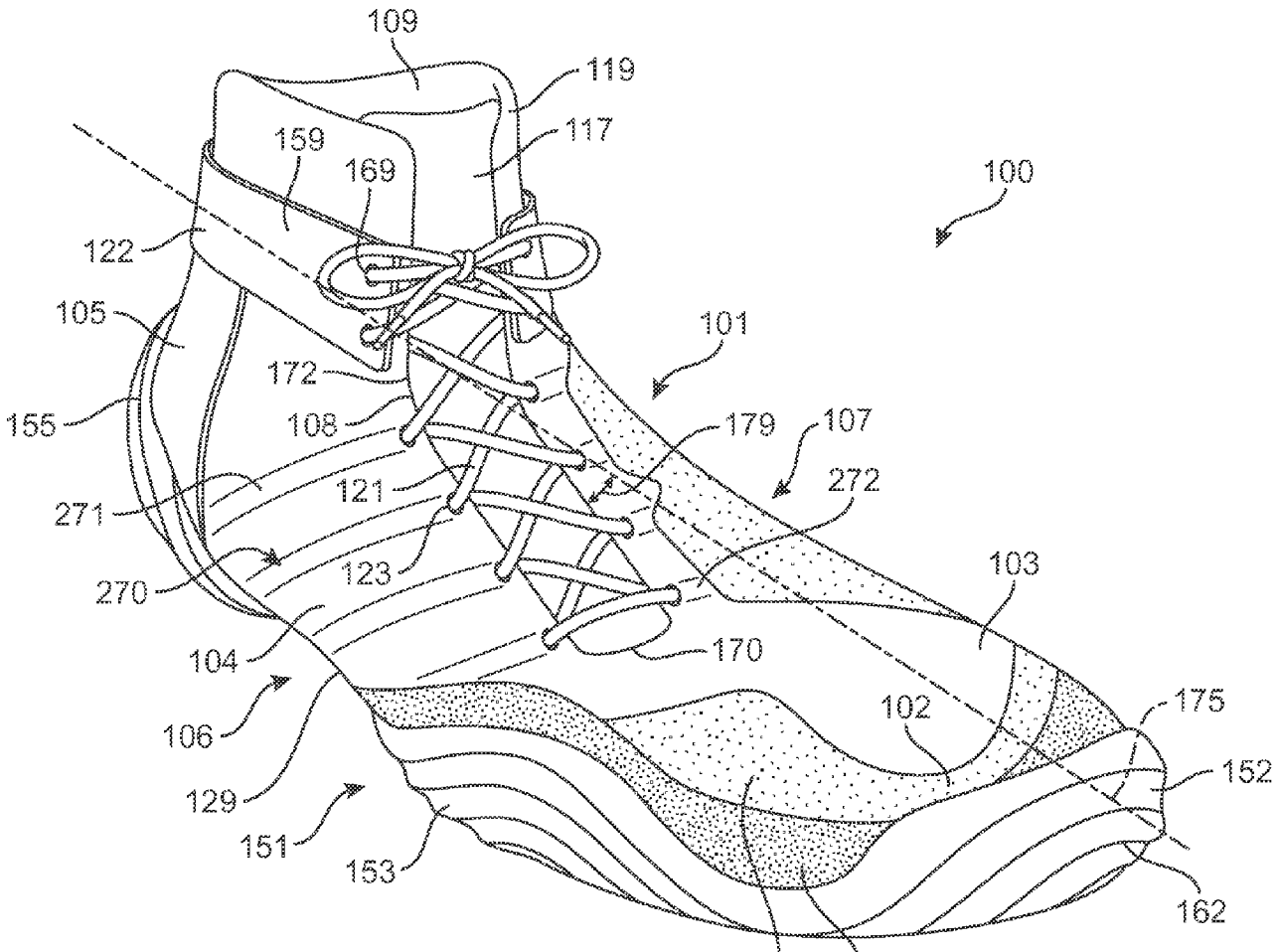
FIG. 1 is a schematic perspective top side view of an embodiment of an article of footwear.

FIG. 1 is a front perspective view of an exemplary embodiment of an article of footwear 100, also referred to simply as article 100. Referring to FIG. 1, article 100 may include an upper 101 and a sole 151. Generally, upper 101 may be any type of upper. In particular, upper 101 may have any design, shape, size and/or color. For example, in some embodiments, upper 101 could be a high top upper that is shaped to provide high support on an ankle. In other embodiments, upper 101 could be a low top upper. In the exemplary embodiment of a wrestling shoe, upper 101 could be a mid-top upper with some portions extending near or around the ankle.

In some embodiments, upper 101 includes an ankle opening 109 that provides entry for the foot into an interior cavity of upper 101. In some embodiments, upper 101 may include a tongue 117 that provides cushioning and support across the instep of the foot.

In some embodiments, sole 151 may be configured to provide traction for article 100. In addition to providing traction, sole 151 may attenuate ground reaction forces when compressed between the foot and the ground during walking, running or other ambulatory activities. The configuration of sole 151 may vary significantly in different embodiments to include a variety of conventional or non-conventional structures. In some cases, the configuration of sole 151 can be configured according to one or more types of ground surfaces on which sole 151 may be used. Examples of ground surfaces include, but are not limited to, a wrestling mat, a playing surface, natural turf, synthetic turf, dirt, as well as other surfaces.

Sole 151 is secured to upper 101 and extends between the foot and the ground when article 100 is worn. In different embodiments, sole 151 may include different components. For example, sole 151 may include an outsole, a midsole, and/or an insole. In some embodiments, one or more of these components may be optional.

Each of upper 101 and sole 151 may be characterized as having various different regions. It will be understood that the following regions are only intended for purposes of description and are not intended to demarcate precise regions of article 100. As shown in FIG. 1, upper 101 has a toe region 102, a forefoot region 103, a midfoot region 104 and a heel region 105. Upper 101 also has an eyestay region 108. Similarly, sole 151 has a toe region 152, a forefoot region 153 and a heel region 155.

Article 100 may be further associated with a lateral side 106 and a medial side 107. In particular, lateral side 106 and medial side 107 may be opposing sides of article 100. It will be understood that lateral side 106 and medial side 107 are intended to represent generally two sides of article 100, rather than precisely demarcating article 100 into two halves.

Different embodiments of article 100 can include various fastening provisions, including, but not limited to laces, cables, straps, buttons and zippers as well as other provisions known in the art for fastening articles. In the embodiment depicted in FIG. 1, eyestay region 108 of upper 101 may include various eyelets or other openings to receive portions of laces 121. For example, in some embodiments, eyestay region 108 may further include plurality of eyelets 123, also referred to simply as eyelets 123 hereafter, that receive portions of lace 121.

In some embodiments, article 100 may include one or more reinforcing strips 270. As seen in FIG. 1, reinforcing strips 270 connect plurality of eyelets 123 to a lower periphery 129 of upper 101. Reinforcing strips 270 may further include lateral reinforcing strips 271 and medial reinforcing strips 272. As seen by viewing FIGS. 1-3, lateral reinforcing strips 271 may be clearly visible on lateral side 106 of upper 101. In contrast, in at least some embodiments, medial reinforcing strips 272 may be covered over by additional layers of upper 101, and therefore may not be visible on medial side 107 of upper 101, or may only be partially visible on medial side 107.

In some embodiments, reinforcing strips 270 may be comprised of materials that are substantially more rigid than materials comprising the remainder of upper 101. In particular, in at least some embodiments, reinforcing strips 270 may comprise materials that resist longitudinal stretching (i.e., lengthwise stretching). This allows reinforcing strips 270 to apply tension directly between eyestay region 108 and lower periphery 129 of upper 101, without substantial stretching.

At least some embodiments may also include one or more straps to further facilitate fastening article 100 to a foot. In the embodiment of FIG. 1, article 100 includes ankle straps 122. In some embodiments, ankle straps 122 wrap around ankle opening 109 to provide support to the wearer's ankle. In some embodiments, ankle straps 122 may be attached to the back of the heel of the article of footwear. In some cases, ankle strap 122 may be attached to the back of heel region 105 of upper 101. In other cases, ankle straps 122 may be attached to the back of heel region 155 of sole 151. In still other cases, ankle straps 122 may be attached to the back regions of both upper 101 and sole 151. As shown in FIG. 1, lace 121, after being threaded through eyelets 123 in eyestay region 108, may then be threaded through eyelets 169 in the ends 159 of ankle straps 122. This facilitates the fastening of ankle portion 119 of upper 101 to the wrestler's ankle.

Embodiments can include provisions to make it more difficult for an opponent or other person to grasp an article of footwear during a competition, such as a wrestling match. In some embodiments, an article of footwear could include provisions to make it more difficult for an opponent to grasp discrete features of the article, such as fasteners and edges associated with the eyestays of the article. Still other embodiments could incorporate provisions to make at least some portions of the article more slippery, such as portions of the upper.

Figure 2:
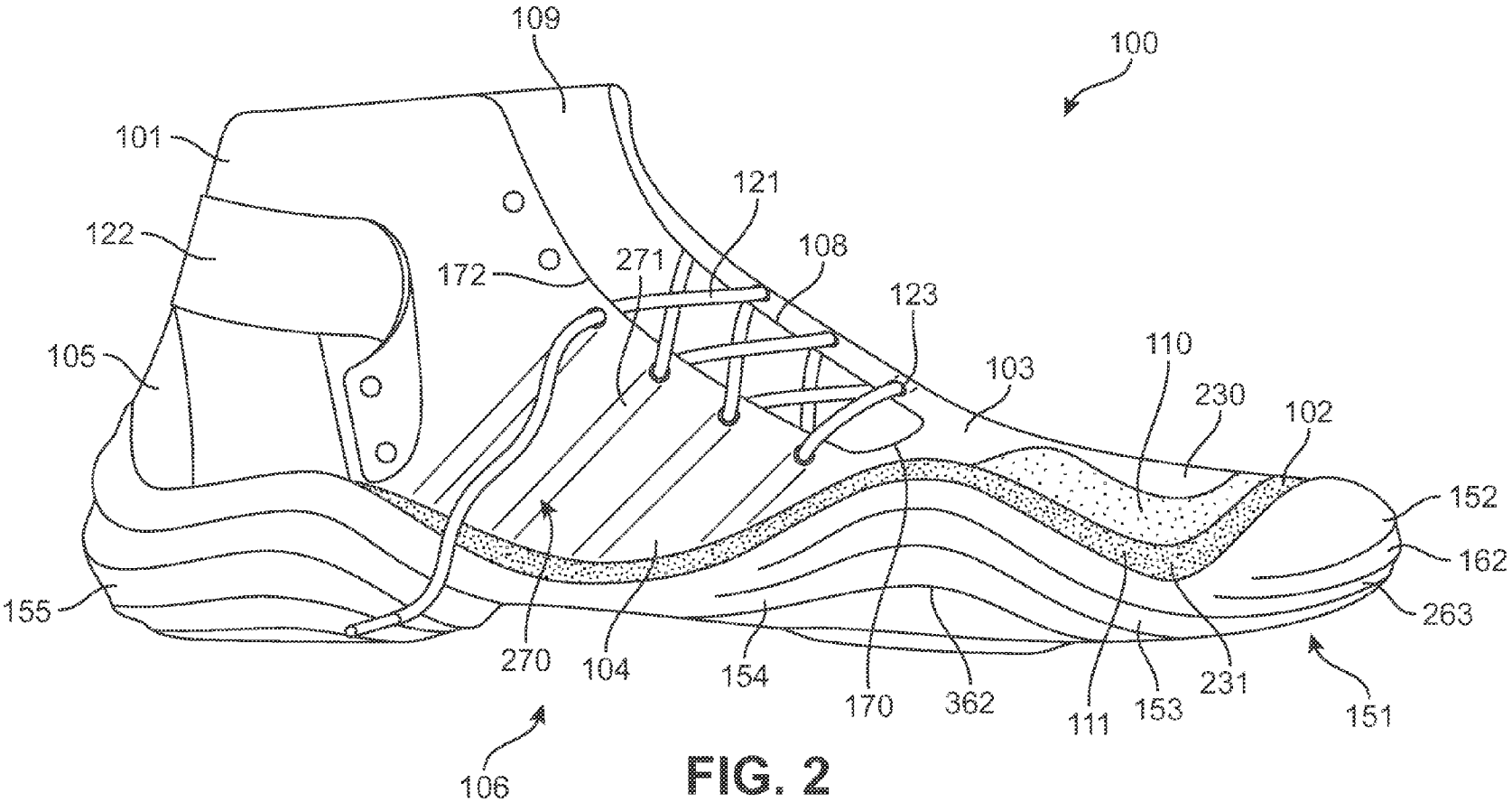
FIG. 2 is a schematic view of the lateral side of the embodiment of FIG. 1.
Figure 3:
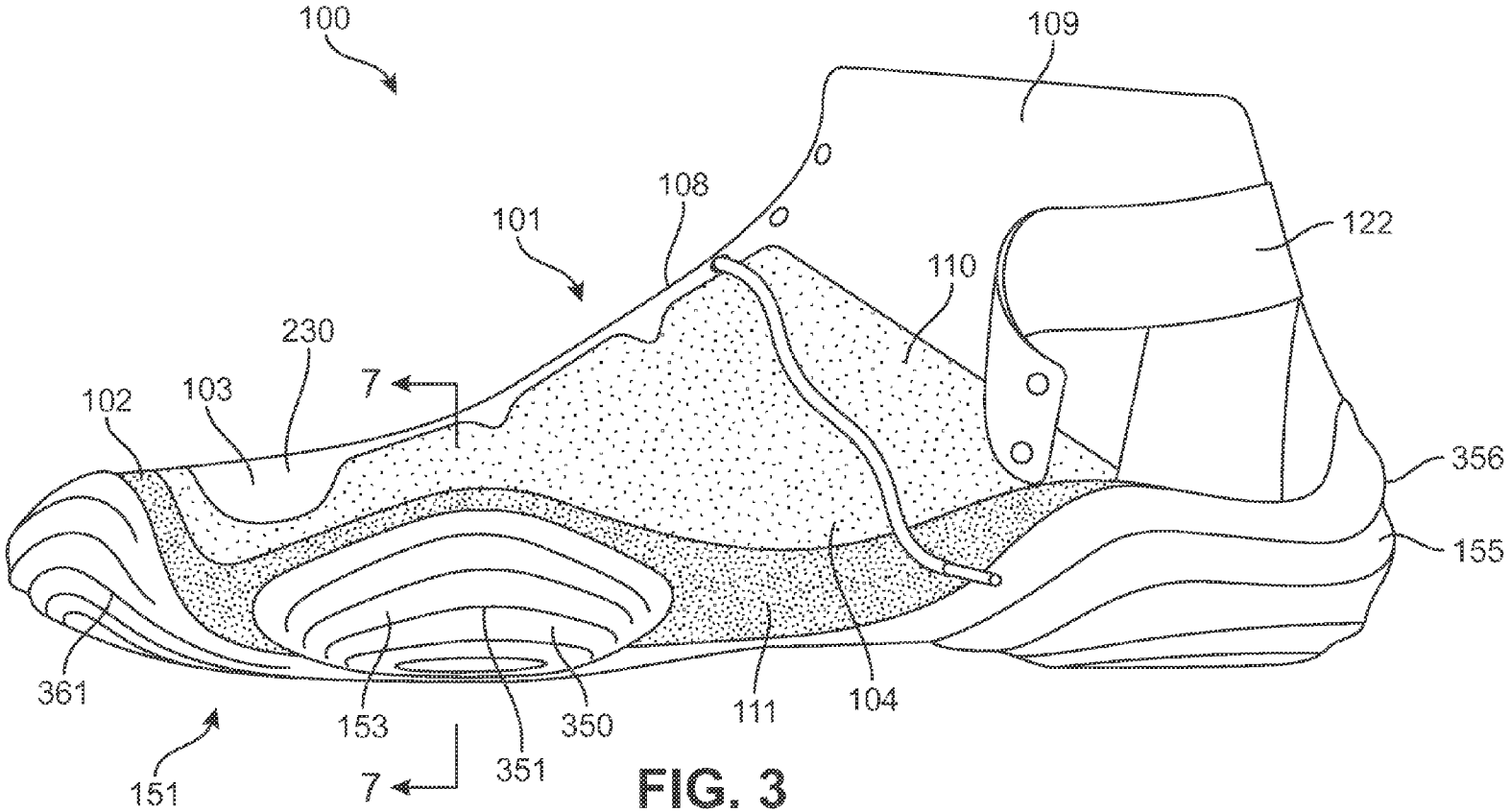
FIG. 3 is a schematic view of the medial side of the embodiment of FIG. 1.
Figure 4:
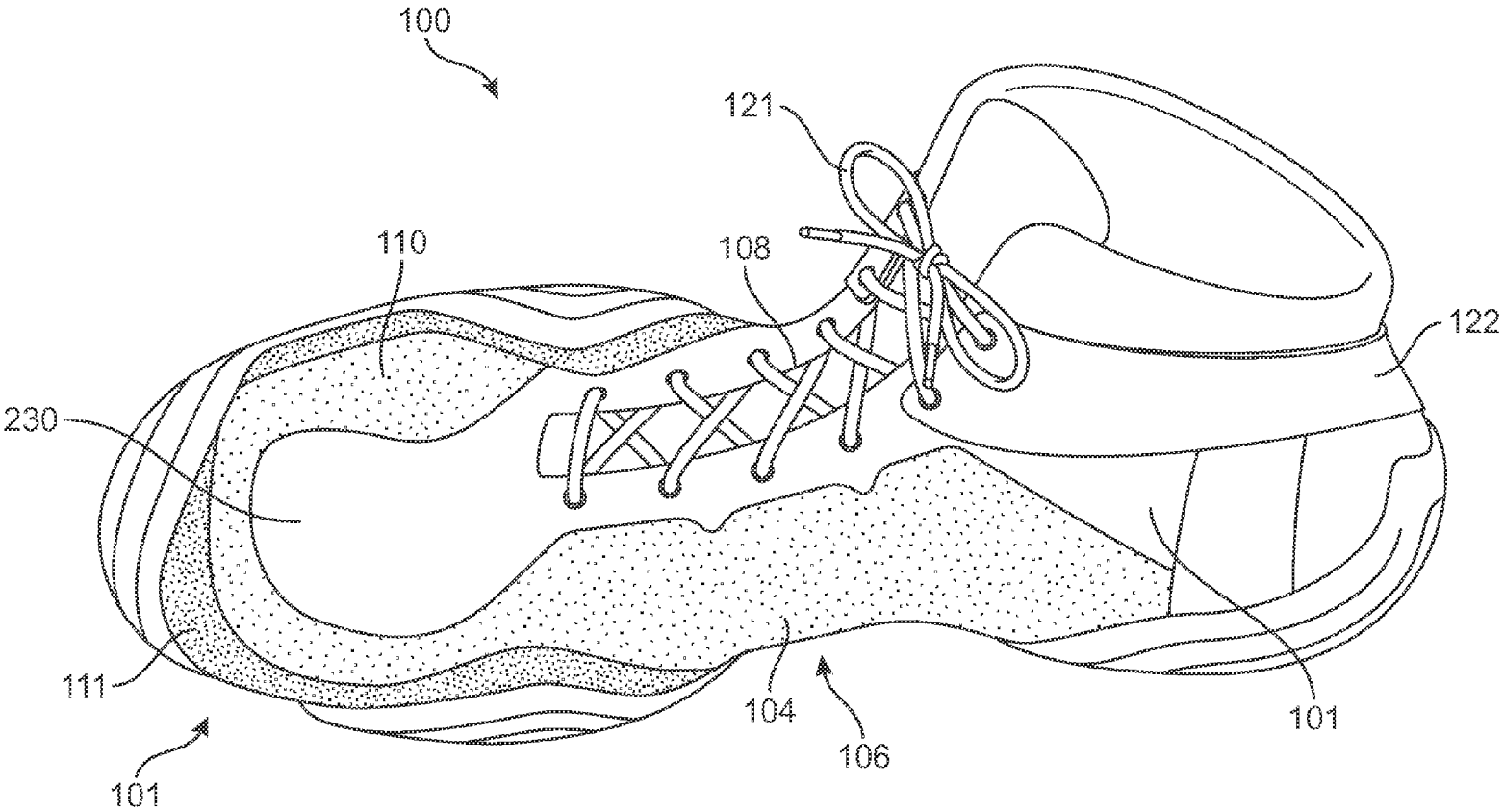
FIG. 4 is a schematic perspective front top view of the embodiment of FIG. 1.
Figure 5:
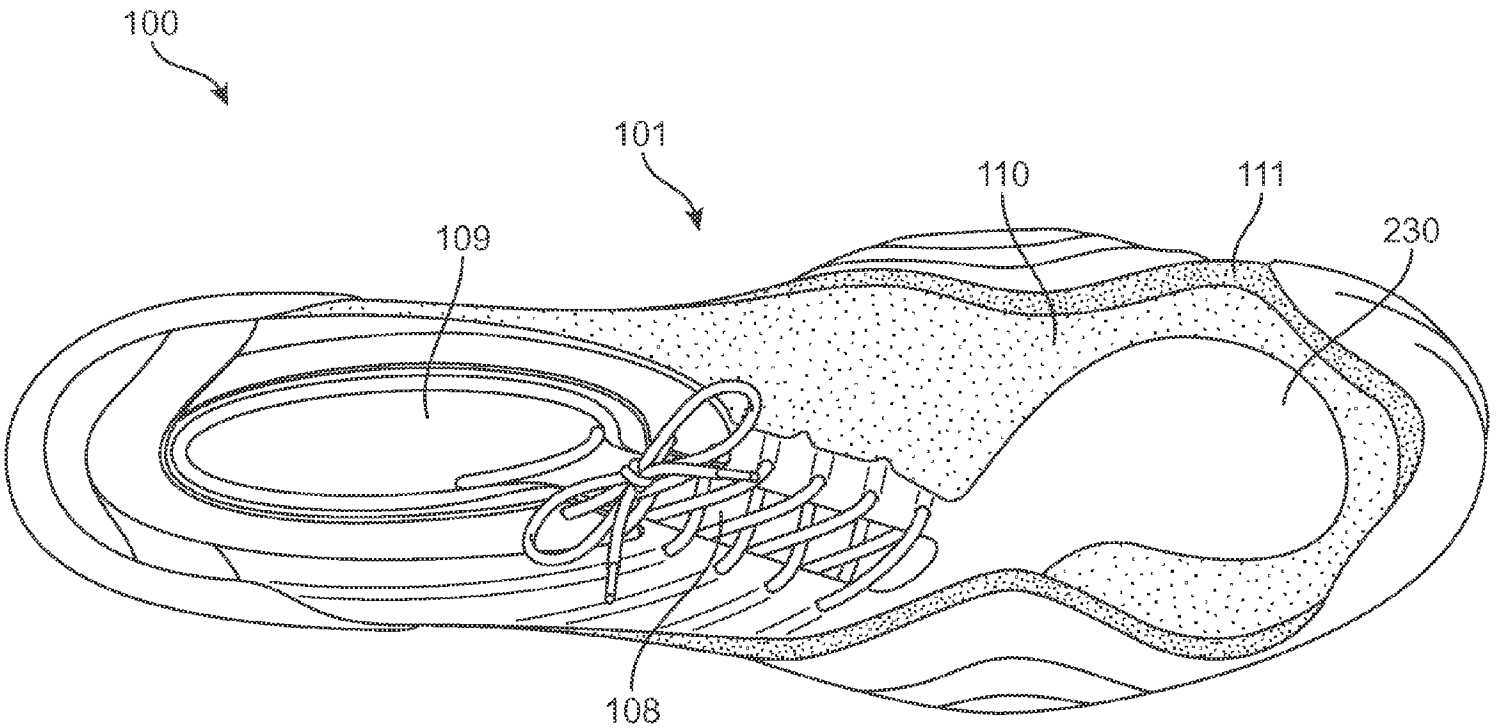
FIG. 5 is a schematic top view of the embodiment of FIG. 1.

FIGS. 2-5 are different views that illustrate the disposition of eyestay region 108 on article of footwear 100. Specifically, FIG. 2 illustrates a lateral side view of an embodiment of article of footwear 100, FIG. 3 illustrates a medial side view of the embodiment of article 100, FIG. 4 illustrates a top down isometric view of the embodiment of article 100, and FIG. 5 is a schematic top view of the embodiment of article 100.

Referring now to FIGS. 1-5, in some embodiments, eyestay region 108 may be biased towards one side of article 100. In some embodiments, eyestay region 108 may be biased towards a medial side of upper 101. In the embodiment depicted in FIGS. 1-5, eyestay region 108 may be biased towards lateral side 106 of upper 101. Specifically, in the exemplary embodiment, eyestay region 108 extends from the front of ankle opening 109 down towards lateral side 106 of forefoot region 103. Due to this bias of eyestay region 108 away from the center of upper 101, a forward end portion 170 of eyestay region 108 may be disposed further from a central longitudinal axis 175 (shown in FIG. 1) of article 100 than a rearward end portion 172 of eyestay region 108. As clearly shown by comparing FIGS. 2 and 3, a majority of eyestay region 108 is associated with lateral side 106, while a much smaller portion of eyestay region 108 is associated with medial side 107. In at least some embodiments, no portions of eyestay region 108 may be associated with medial side 107.

As clearly indicated in FIG. 1, eyestay region 108 may form an angle 179 with respect to central longitudinal axis 175. In different embodiments, the value of angle 179 could vary in a range between 0 degrees (i.e., no biasing) to 45 degrees, for example. In still other embodiments, angle 179 could be greater than 45 degrees. It is contemplated that some embodiments may utilize a configuration where eyestay region 108 forms an angle approximately in the range between 5 degrees and 30 degrees.

While some embodiments may include an eyestay region that may be approximately straight and biased towards lateral side 106, other embodiments could include eyestay regions that are curved or otherwise non-linear in their configuration. In some embodiments, different portions of the eyestay region could vary in their angular orientation relative to, for example, central longitudinal axis 175.

Biasing the eyestay region to the lateral side may make it more difficult for an opponent to obtain a firm grasp on, for example, a wrestler's shoe. It is more difficult for an opposing wrestler to obtain a firm grasp on a shoe with a biased eyestay region because the opponent's hand has to reach around the apex of the shoe and almost down to the lateral edge of the shoe so that his fingers can grasp the opposite side of the eyestay region.

As best illustrated in FIGS. 2-5, some embodiments may incorporate different portions having different material properties or characteristics. For purposes of characterizing these material differences, upper 101 may be characterized as being comprised of different regions or portions. For example, in some embodiments, upper 101 includes a first portion 110 and a second portion 111, which are shaded in the Figures for purposes of illustration. In an exemplary embodiment, first portion 110 may extend through toe region 102 as well as through midfoot region 104 on medial side 107 of upper 101. In the exemplary embodiment, second portion 111 may extend around a perimeter of forefoot region 103 as well as along midfoot region 104 on both lateral side 106 and medial side 107. As best shown in FIGS. 2-3, second portion 111 may be disposed directly adjacent to portions of sole 151. Also, first portion 110 may be disposed further from sole 151 than second portion 111.

In some embodiments, a third portion 230 of upper 101 may be associated with a top side of forefoot region 103 as well as a majority of lateral side 106 of upper 101. In some embodiments, third portion 230 may comprise a base layer of upper 101 such that first portion 110 and second portion 111 comprise layers disposed over third portion 230. In such embodiments, first portion 110 and/or second portion 111 could comprise overlays that are joined to third portion 230 via bonding, welding or other method of joining layers known in the art. In other embodiments, however, third portion 230 may only extend through some parts of upper 101 and may not be disposed beneath first portion 110 or second portion 111.

In some embodiments, each portion of upper 101 may be made of similar materials. In at least some embodiments, each portion may be associated with different materials. Referring to FIGS. 2-5, for example, first portion 110 may have a first surface that is comprised of a first material. Likewise, second portion 111 may have a second surface that is comprised of a second material. Still further, third portion 230 may have a third surface that is comprised of a third material. In some embodiments, the first material has a first coefficient of friction, the second material has a second coefficient of friction, and the third material has a third coefficient of friction. In one embodiment, the third coefficient of friction is substantially less than the second coefficient of friction. For example, the third coefficient of friction may be less than half of the second coefficient of friction. In other words, third portion 230 of upper 101 may be more slippery than second portion 111 of upper 101. Additionally, in one embodiment, the third coefficient of friction may be roughly similar to the first coefficient of friction. In other words, third portion 230 of upper 101 and first portion 110 of upper 101 may be more slippery than second portion 111 of upper 101. Because both third portion 230 and first portion 110 are configured as more slippery than second portion 111, it may therefore be more difficult for an opponent to firmly grasp the footwear at the forefoot. In some embodiments, the second coefficient of friction may be greater than the first coefficient of friction by at least an order of magnitude. In some embodiments, second material in portion 111 may have a surface 253 that is tacky and has a high coefficient of friction against a playing surface, such as, for example, a wrestling mat.

In some embodiments, the first material may be the same as the third material. In still other embodiments, the first material may be substantially different from the third material. For example, in at least some embodiments, the coefficient of friction of the third material in portion 230 of upper 101 may be lower than the coefficient of friction of the material in first portion 110 of upper 101. By varying the coefficient of friction of different materials in different portions, the slip properties of upper 101 can be tuned at individual portions that may differ in the likelihood of each portion being grasped by an opponent.

In different embodiments, first portion 110 and third portion 230 may be comprised of various kinds of upper materials, including various textile materials, such as woven or non-woven fabrics, knits, meshes or other materials. For example, first portion 110 and/or third portion 230 may be made of a spacer mesh material. This combination of different materials for upper 101 may provide both resistance to grasping by an opponent (due to the slippery surfaces of first portion 110 and third portion 230) and traction at the perimeter of the upper (for example, due to tackiness of portion 111)

In some embodiments, the first material of first portion 110 and the second material of second portion 111 may extend throughout the thickness of upper 101. However, in other embodiments, the first material of first portion 110 and the second material of second portion 111 could comprise overlays that are disposed over, for example, a textile material or other textile layer.

Embodiments can include provisions to increase traction for an article. In some embodiments, an article may have sole pads that are configured to facilitate traction with a surface, such as a wrestling mat.

As shown in FIGS. 1-10 certain of the peripheral regions of sole 151, such as toe region 152, lateral forefoot region 153 and heel region 155 may have pads that may curve up from the bottom of the sole to provide surfaces that extend upwardly and outwardly from the bottom of the sole. The surfaces of these pads may have ridges that may provide unidirectional traction when that region of the shoe is pressed down against a wrestling mat or other playing surface.

Figure 6:
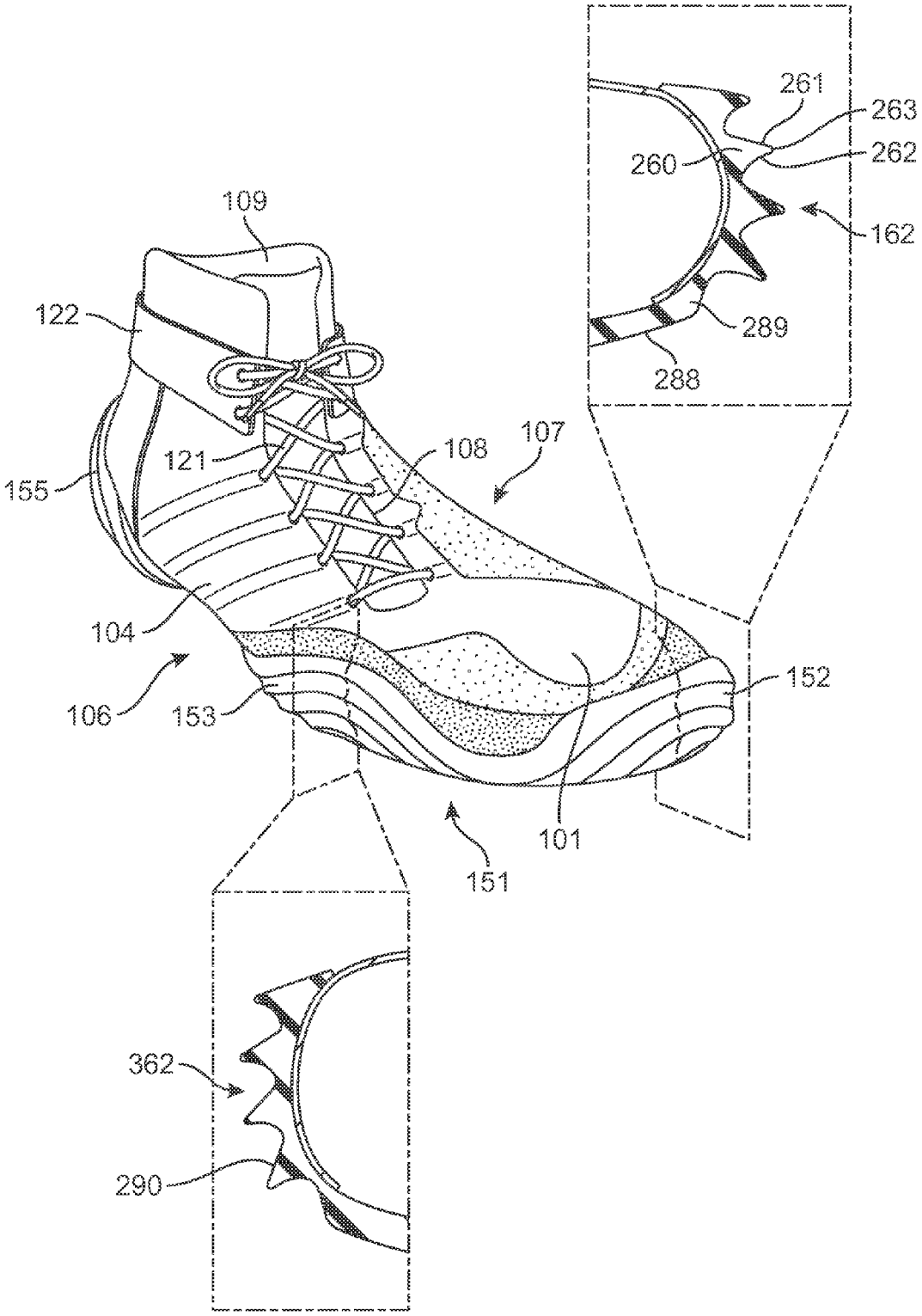
FIG. 6 is a schematic perspective view of the embodiment of FIG. 1, showing cross-sections of the edges of the toe region and the forefoot region.

FIG. 6 illustrates a front isometric view of sole 151 including two enlarged cross-sectional views of toe region 152 and lateral forefoot region 153, which illustrate the geometry of these regions. In some embodiments, toe region 152 includes a lower portion 288 and a side portion 289. As seen in FIG. 6, side portion 289 may include ridges 162. Likewise, lateral forefoot region 153 is seen to include ridges 362 on a side portion 290 of sole 151.

Generally, the geometry of ridges comprising ridges 162 and ridges 362 may vary. As one example of a possible geometry for ridges of sole 151, the geometry of a ridge 260 of ridges 162 is shown in FIG. 6. Ridge 260 may include an upwardly oriented surface 261 along with a downwardly oriented surface 262. Upwardly oriented surface 261 and downwardly oriented surface 262 may meet at a peak portion 263 of ridge 260. Here, the term upwardly oriented surface is intended to include any surface with a normal component that is oriented at least partially in the upwardly vertical direction, i.e., in a direction extending from sole 151 towards upper 101. Likewise, the term downwardly oriented surface is intended to include any surface with a normal component that is oriented at least partially in the vertically downwardly direction, i.e., in a direction opposite of the upward direction. In at least some embodiments, each of the remaining ridges of sole 151 may be configured with a similar geometry including an upwardly oriented surface and a downwardly oriented surface.

As seen in the enlarged views of FIG. 6, the downwardly oriented surfaces of ridges 162 and ridges 362 may be configured to engage a playing surface, such as a wrestling mat, in order to provide enhanced traction. In at least some embodiments, moreover, the peak portions of each of ridges 162 and ridges 362 may partially dig into a mat, in order to increase traction with the mat.

Figure 7:
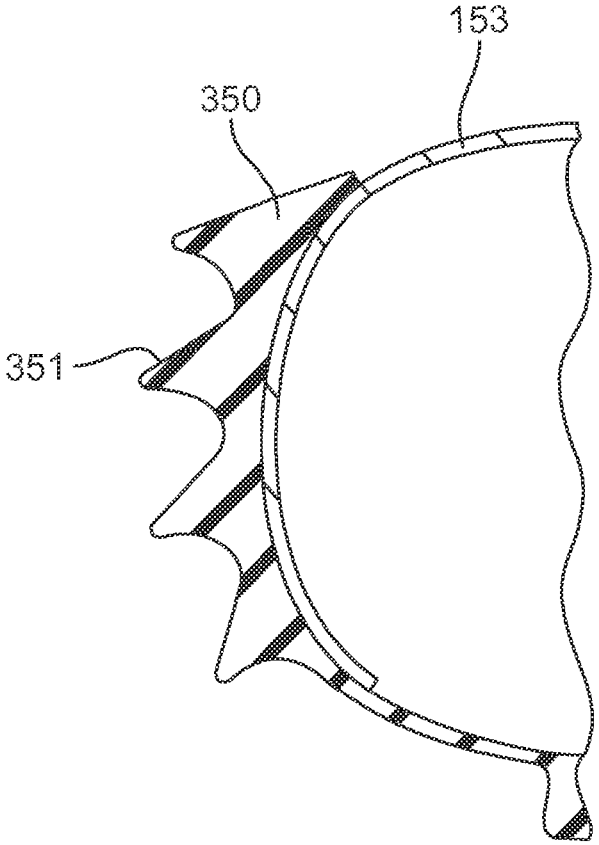
FIG. 7 is a schematic cross-section of the edge of the forefoot on the medial side of the embodiment of FIG. 1.

FIG. 7 is a schematic diagram of a cross section of a pad 350 in forefoot region 153 of sole 151, taken at 7-7 in FIG. 3. As seen in FIG. 7, medial pad 350 in forefoot region 153 includes ridges 351 that may act to enhance traction on the medial side of article 100.

Figure 8:
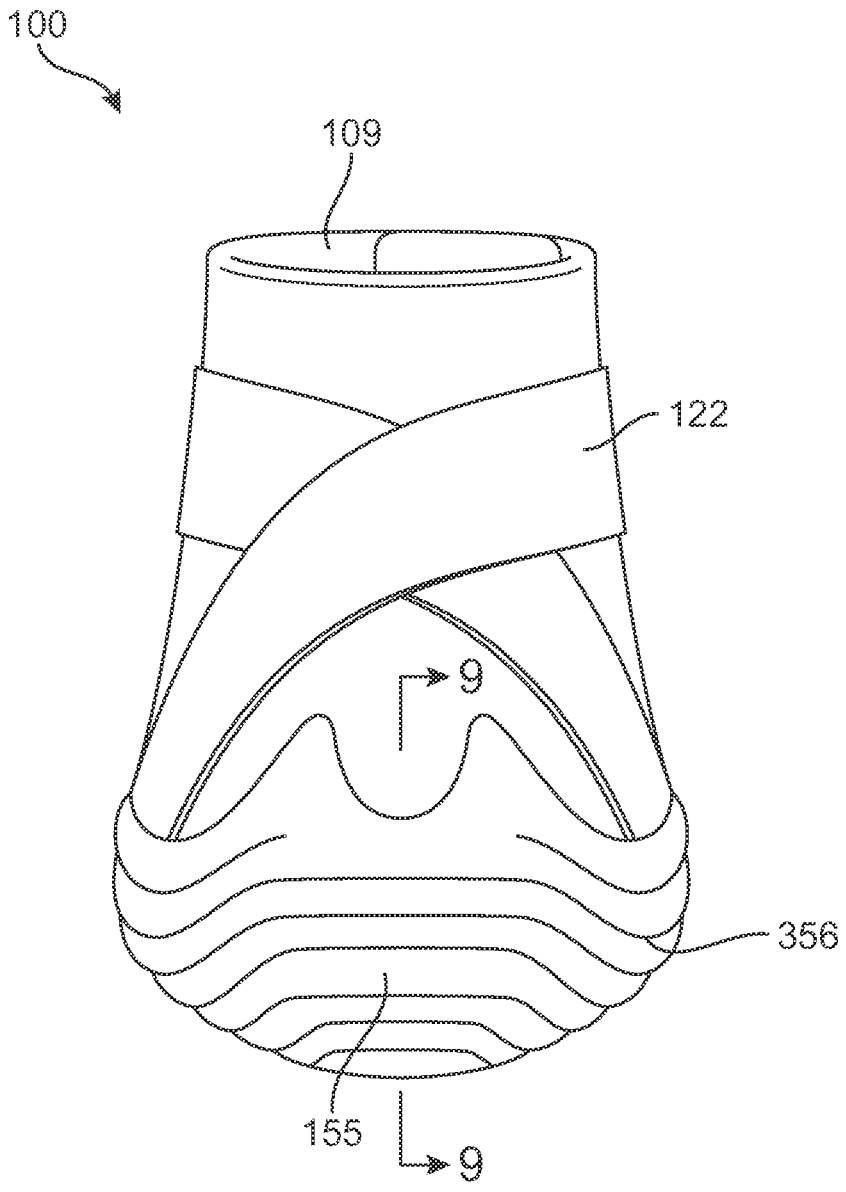
FIG. 8 is a schematic perspective view of the heel region of the embodiment of FIG. 1.
Figure 9:
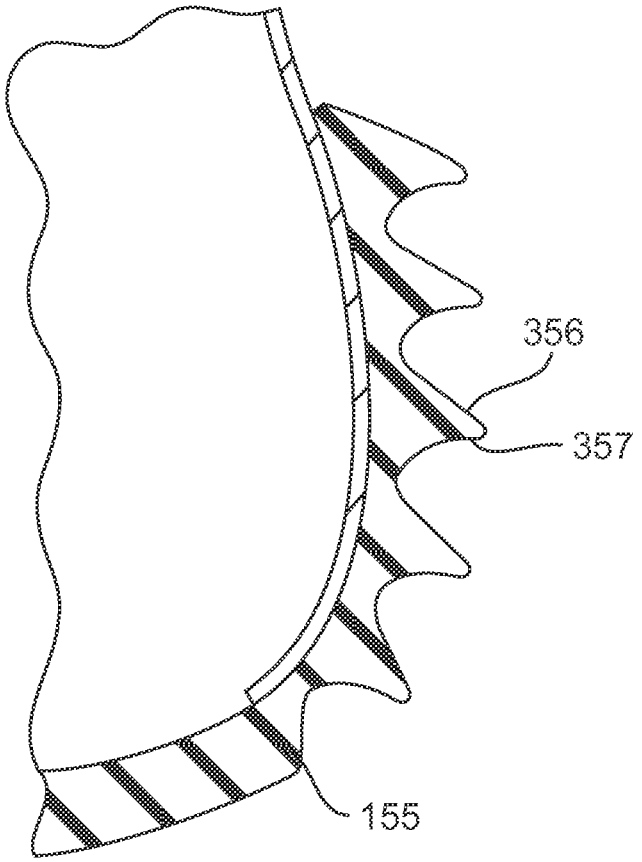
FIG. 9 is a cross-section of the edge of the heel taken at 9-9 in FIG. 8.

FIG. 8 is a schematic diagram of a perspective view of the heel of the embodiment of article 100 in FIG. 1. FIG. 9 is a cross-section of the back of heel region 155 of sole 151 taken at 9-9 of FIG. 8. As seen in FIGS. 8 and 9, ridges 356 may be disposed on the back of heel region 155 of article of footwear 100. Ridges 356 may include downwardly facing surfaces 357 that may be configured to engaged a playing surface and improve traction for heel region 155. With these ridges, the wearer can gain increased traction by digging the heel into a playing surface (such as a wrestling mat) with the edges of the ridges opposing the motion, or allow the heel to slide along if the ridges are slanted so as not to oppose the motion.

Figure 10:
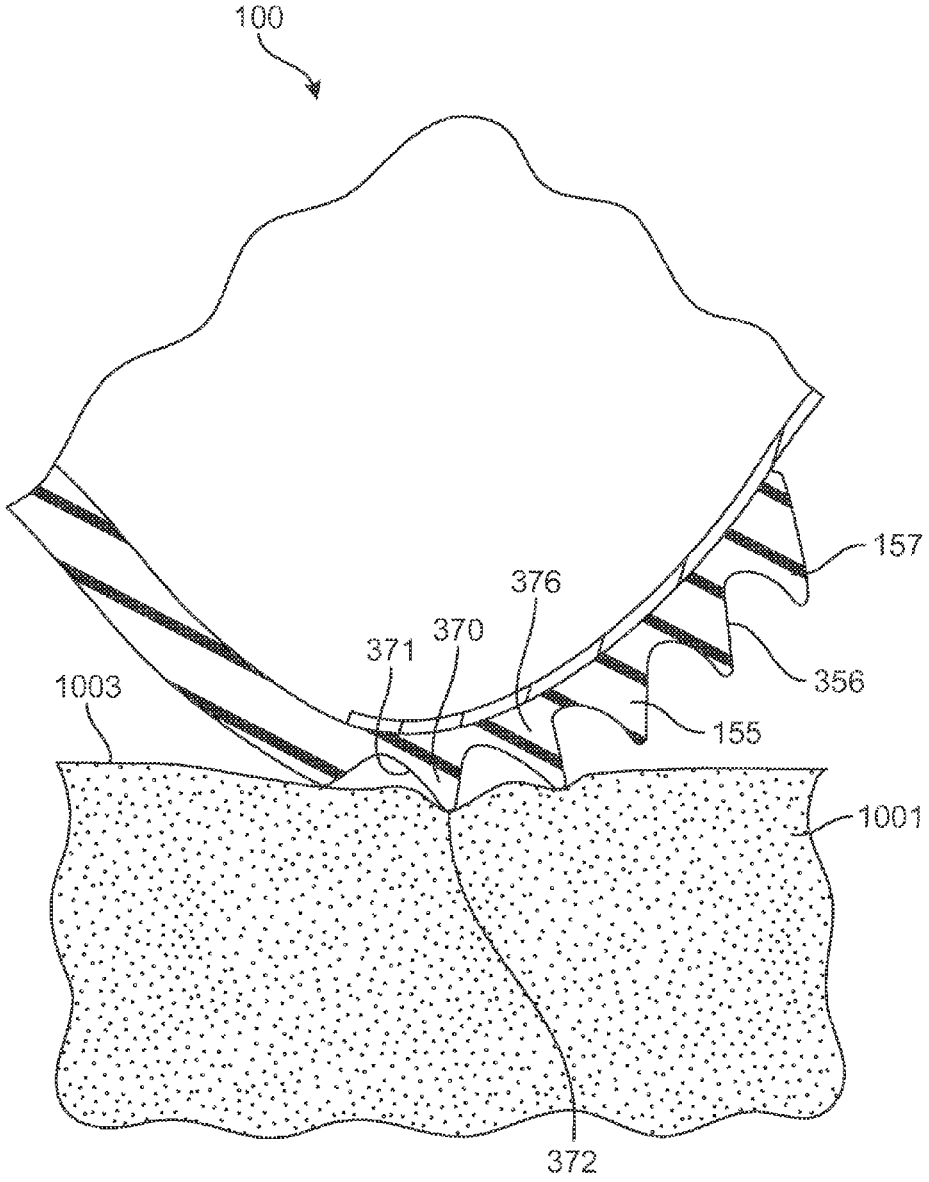
FIG. 10 is a schematic diagram showing the heel of the embodiment of FIG. 1 digging into a playing surface.

FIG. 10 is a cross-section of heel region 155 of sole 151 contacting a wresting mat 1001. Referring to FIG. 10, such a configuration may occur when a wrestling is attempting to dig in with his heel. As seen here, as article 100 tilts back, rear side portion 157 of heel region 155 contacts surface 1003 of mat 1001. As seen in FIG. 10, ridges 356 engage surface 1003. For example, a first ridge 370 of heel region 155 may deform so that an inner side 371 of first ridge 370 contacts surface 1003. Further, in some cases, a tip 372 of first ridge 370 may also dig slightly into surface 1003 to further improve traction. As shown in FIG. 10, a second ridge 376 may also deform and contact surface 1003. Because the wearer can dig ridges 356 into the playing surface, the wearer obtains greater leverage when pushing against, for example an opponent or a heavy obstacle.

Figure 11:
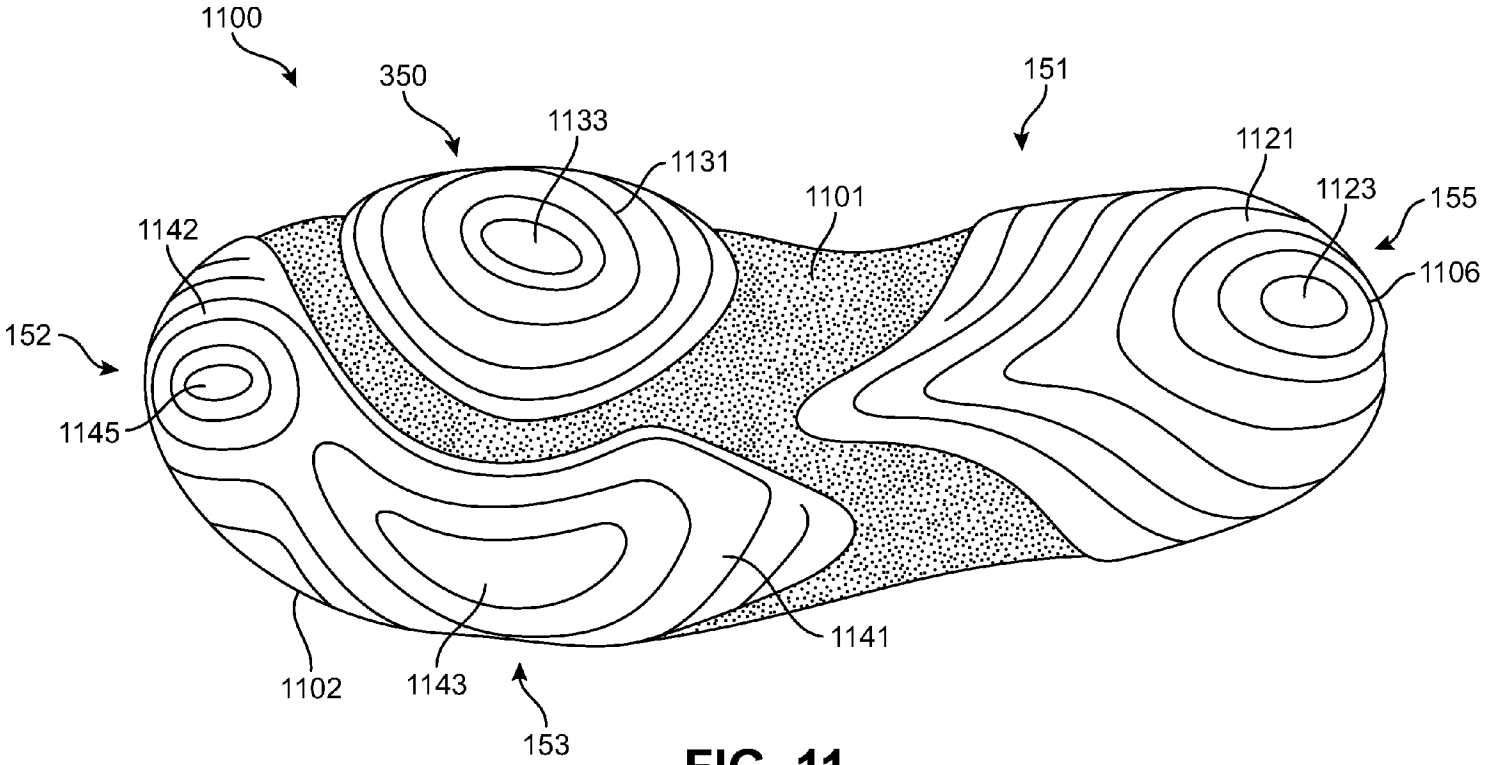
FIG. 11 is a schematic view of an outsole that may be used with the embodiment of FIG. 1.

FIG. 11 is a bottom view of an embodiment of an outsole 1100 that could be used with the embodiment of FIG. 1. In some embodiments, outsole 1100 may generally comprise distinct pad portions that are continuous with the portions of sole 151 shown in FIGS. 1-10. For example, a forefoot pad 1102 of outsole 1100 may comprise the lower side of lateral forefoot region 153 and toe region 152 of sole 151, which are shown for example in FIG. 1. In some embodiments, outsole 1100 also includes a heel pad 1006, which comprises the lower side of heel region 155 of sole 151. Likewise, outsole 1100 may include a lower portion of medial pad 350 that is also depicted in, for example, FIG. 3. In some embodiments, forefoot pad 1102, medial pad 350 and heel pad 1006 may be disposed over, or otherwise joined with, a base layer 1101 of sole 151.

Generally, each pad of outsole 1100 may comprise concentric ridges that encircle a central region. As an example, heel pad 1106 has a plurality of concentric ridges 1121 that form a rough oval pattern around a central region 1123 at the rear end of outsole 1100. This pattern evolves towards more pointed geometries, with the most forward of the ridges forming a curvilinear V pattern. Medial pad 350 also has concentric, generally oval-shaped ridges 1131 that encircle a central region 1133 as shown in FIG. 11. Forefoot pad 1102 includes a first pattern of concentric ridges 1141 forming a crescent moon pattern around a central region 1143 on the lateral side of the forefoot. Forefoot pad 1102 also includes a second pattern of concentric ridges 1142 forming ovals around a central region 1145 under the big toe portion of the sole, as also shown in FIG. 11. These various ridge patterns may enhance traction with a playing surface.

Figure 12:
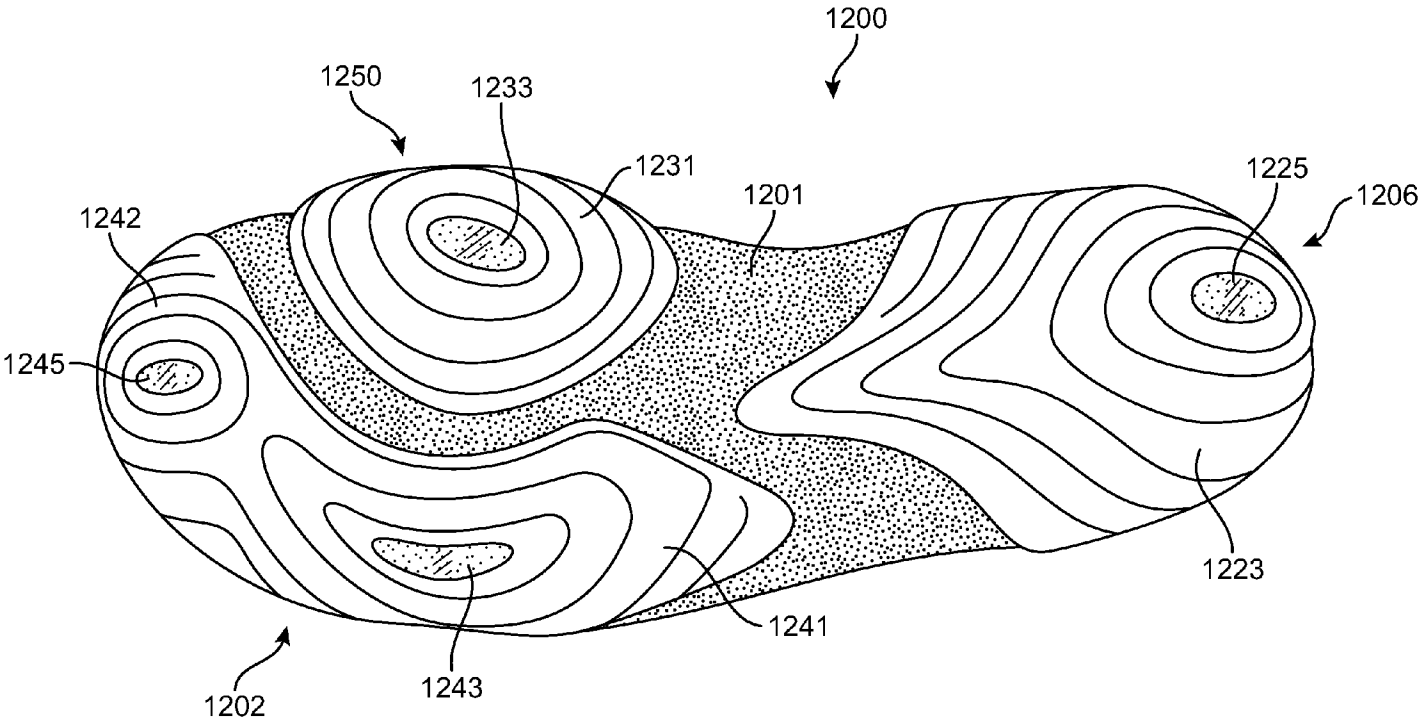
FIG. 12 is a schematic view of another outsole that may be used with the embodiment of FIG. 1.

FIG. 12 is a bottom view of an alternative embodiment of an outsole that may be used with an article of footwear. This figure shows an outsole 1200 that could be used with the embodiment of FIG. 1. As with the previous embodiment of outsole 1100, depicted in FIG. 11, this embodiment includes a base layer 1201 covered with several pads, including a forefoot pad 1202, a medial pad 1250 and a heel pad 1206. Each pad may generally comprise ridges in concentric patterns. For example, forefoot pad 1202 comprises concentric ridges 1241 that surround forefoot central region 1243. Forefoot pad 1202 also comprises concentric ridges 1242 that surround toe central region 1245. Furthermore, medial pad 1250 comprises concentric ridges 1231 that encircle medial central region 1233. Finally, heel pad 1206 comprises concentric ridges 1223 that encircle heel central region 1225.

In contrast to the previous embodiment, the embodiment depicted in FIG. 12 may incorporate one or more apertures. In particular, in some embodiments, each of forefoot central region 1243, toe central region 1245, medial central region 1233 and heel central region 1225 may comprise apertures in each corresponding pad. In this embodiment, therefore, portions of base layer 1201 may be disposed through these apertures. Moreover, in an exemplary embodiment, the portions of base layer 1201 that are exposed through forefoot central region 1243, toe central region 1245, medial central region 1233 and heel central region 1225 may be covered with a layer of material. Exemplary materials that could be used with these regions include, but are not limited to: polymer materials or other textile materials. The use of apertures within each pad may allow for increased breathability as air and moisture from an upper can pass through base layer 1201 of sole 1200 and out through the apertures.

Figure 13:
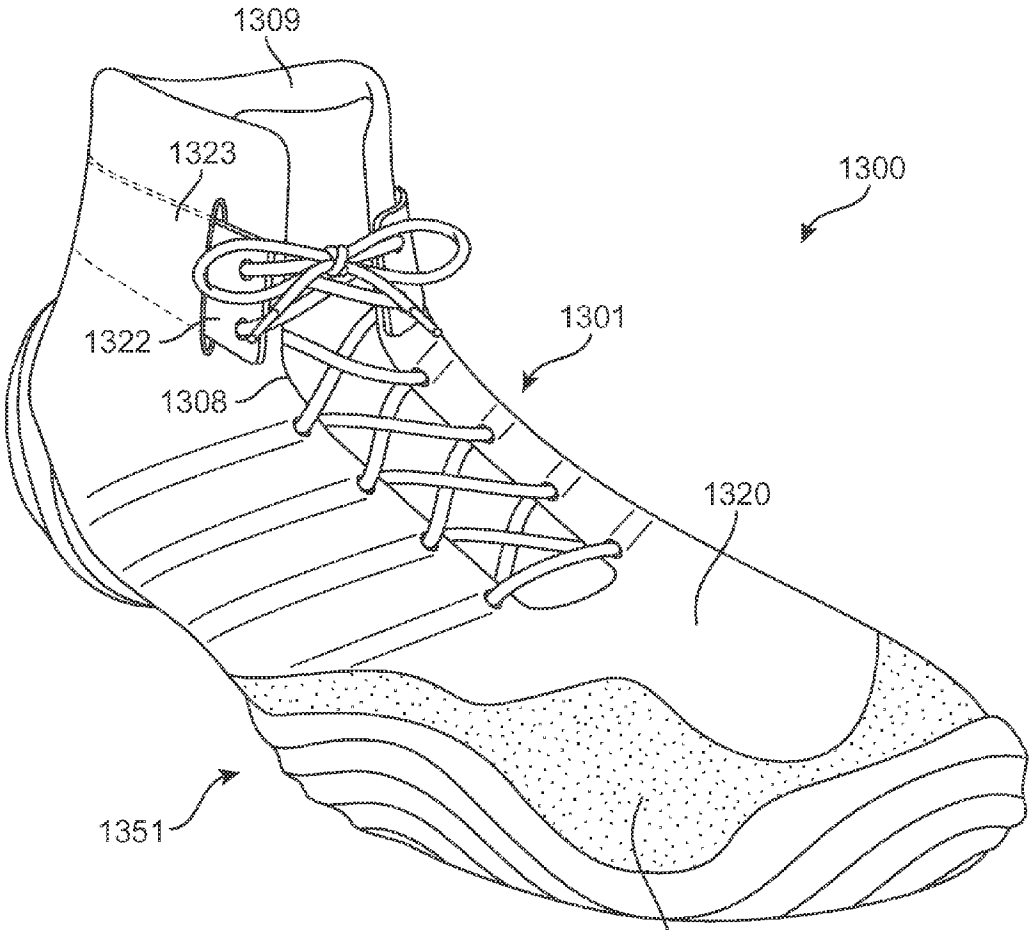
FIG. 13 is a schematic perspective top side view of another embodiment of an article of footwear.

FIG. 13 is a schematic diagram of another embodiment of an article of footwear 1300, also referred to simply as article 1300. As seen by comparing FIG. 13 with FIG. 1, some embodiments of article of footwear 1300 may incorporate some similar features to article 100 (shown in FIG. 1). However, in some embodiments, article 1300 may include some additional features, and may lack some features of article 100. It should be understood that any features of these two embodiments could be interchanged according to intended use of the article.

In an exemplary embodiment, article 1300 includes an upper 1301 and a sole 1351. In some embodiments, upper 1301 may be configured with two distinct material portions, namely a base material portion 1320 and a peripheral material portion 1310. The base material portion has a low coefficient of friction against a person's hand or fingers. In some embodiments, peripheral material portion 1310 may also be comprised of a material that has a low coefficient of friction against a person's hand or fingers.

Additionally, in some embodiments, article 1300 includes ankle straps 1322 that pass around ankle opening 1309 within outer layer 1323 of ankle opening 1309. For purposes of illustration, ankle straps 1322 are mostly shown in phantom in FIG. 13. This configuration of ankle straps 1322 makes it somewhat more difficult for an opponent to obtain a firm grasp around the ankle region of the footwear.

Also, in contrast to the eyestay region 108 of article 100 (shown in FIG. 1), article 1300 incorporates an eyestay region 1308 that may be oriented centrally, rather than biased towards a side of article 1300.

Figure 14:
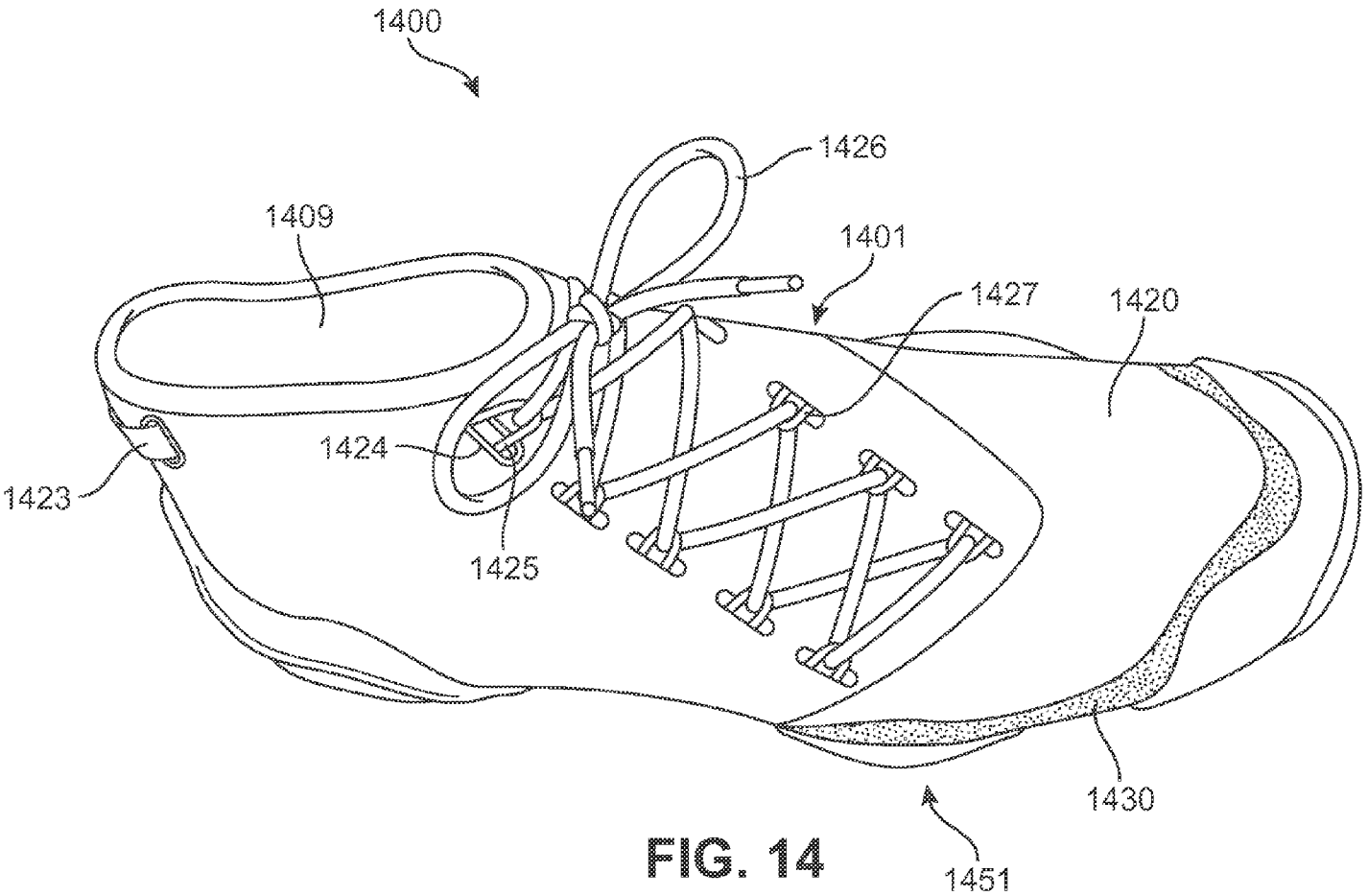
FIG. 14 is a schematic diagram of a perspective lateral side view of another embodiment of an article of footwear.
Figure 15:
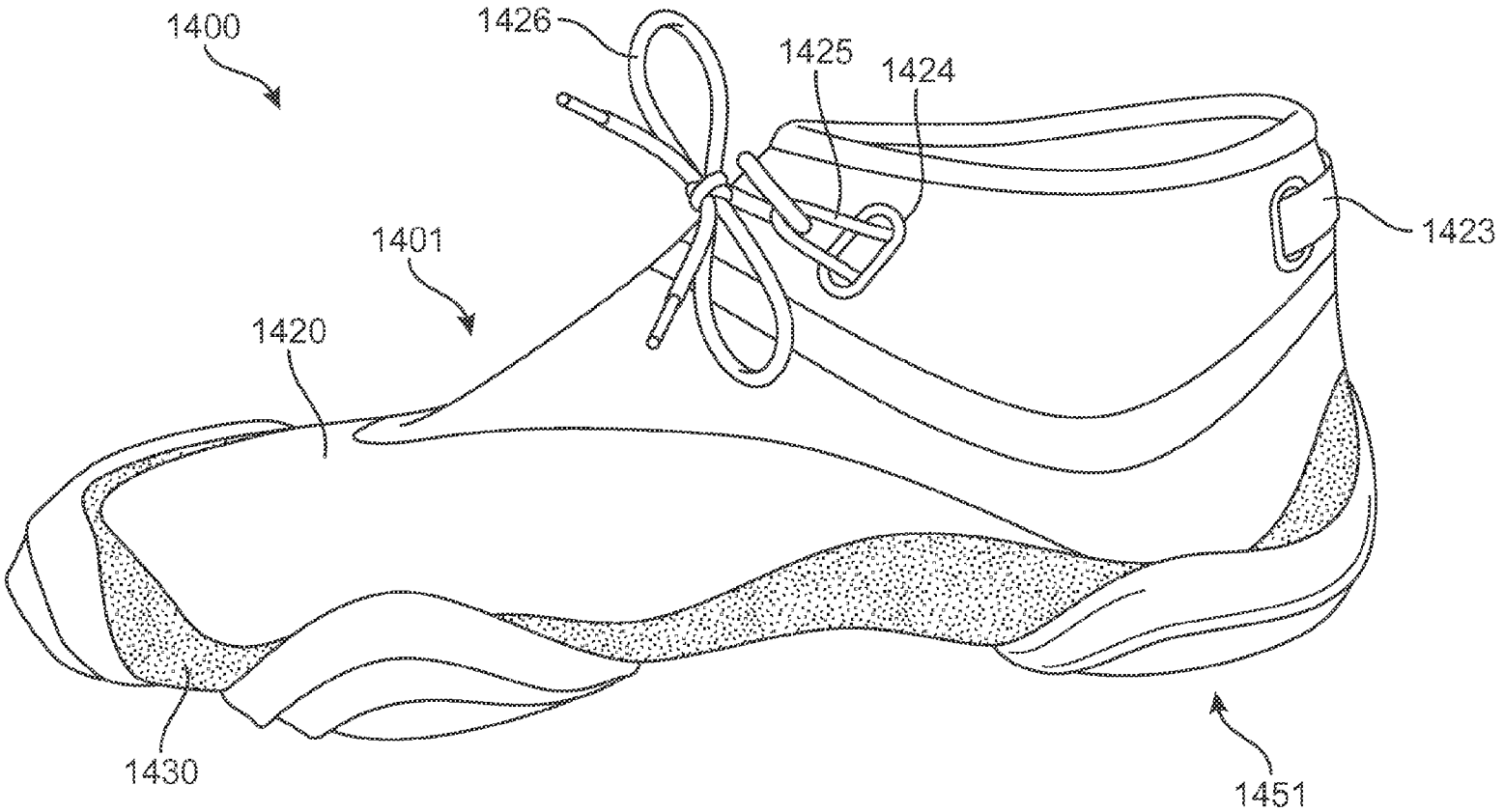
FIG. 15 is a schematic diagram of a medial side view of the embodiment shown in FIG. 14.

FIG. 14 and FIG. 15 are schematic diagrams illustrating another exemplary embodiment of an article of footwear 1400, also referred to herein as article 1400. In the embodiment of FIG. 14 and FIG. 15, article 1400 includes an upper 1401 and a sole 1451. As seen by comparing FIG. 14 and FIG. 15 to FIG. 1 and/or FIG. 13, some embodiments of article of footwear 1400 may incorporate some features similar to features in article 100 and/or article 1300. However, in some embodiments, article 1400 may include additional or different features that are not present in article 100 and/or article 1300. In the embodiment illustrated in FIG. 14 and FIG. 15, upper 1401 has two distinct material portions. Upper 1401 has a smooth, low-friction base material portion 1420 at a portion of upper 1401 and a tacky material portion 1430 at the periphery of the upper.

Thus, in the embodiment of FIG. 14 and FIG. 15, upper 1401 has one low-friction base material portion 1420 and one tacky material portion 1430, whereas the embodiment of FIG. 1 and FIG. 2 has two low-friction material portions 1230 and 110 and one tacky material portion 111, and the embodiment of FIG. 13 has two low-friction material portions 1310 and 1320 and no tacky material portion.

FIG. 14 and FIG. 15 also show ankle strap 1423 wrapped around the back of ankle opening 1409. The ends of ankle strap 1423 emerge from slots 1424 on the lateral side and medial side of ankle opening 1409 as loops 1425. Lace 1426 may be laced through loops 1427 in the forefoot of upper 1401 and through loops 1425 to tighten upper 1401 over a wearer's foot.

Figure 16:
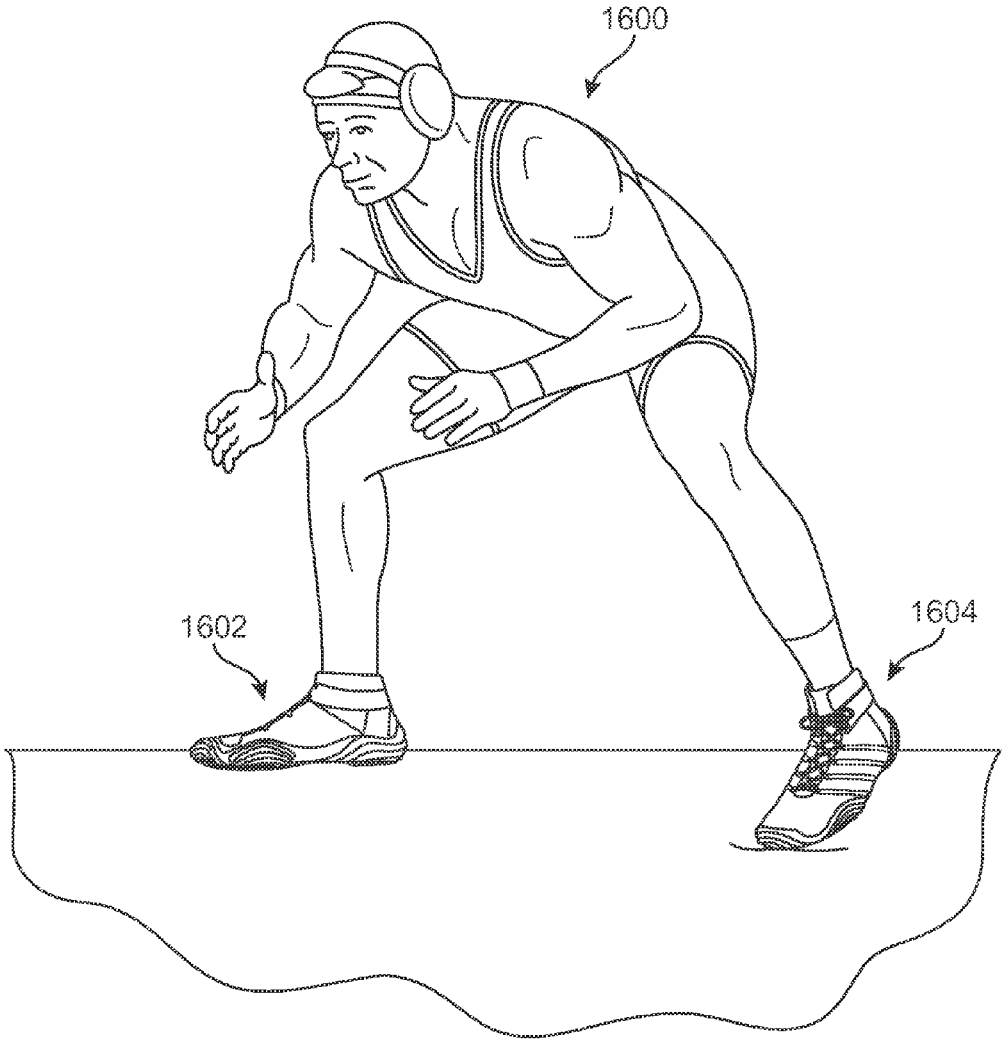
FIG. 16 is a schematic view of a wrestler wearing the embodiment shown in FIG. 1 on each of his feet.

The embodiments shown schematically in FIGS. 1-15 are particularly advantageous when used as a wrestling shoe. FIG. 16 is a schematic view of a wrestler 1600 wearing a first article 1602 and a second article 1604, where both articles include various provisions of, for example, article 100 described previously. These provisions, including a slippery upper surface for each article, biased eyestays and sole pads with ridges, may cooperate to improve the performance of wrestler 1600 in a wrestling match.

In the embodiments described above, some portions of an upper (such as third portion 230 of upper 101 seen in FIG. 1) may be made of leather, synthetic leather, woven textiles, knitted textiles or nonwoven textiles. These materials may have a cushioning sublayer formed, for example, from a lightweight polymer foam material to provide added comfort. In some embodiments, portions of the upper and any sublayers may be made of a moisture-wicking material that wicks away perspiration from the wearer's foot.

In the embodiments described above, some portions of an upper may be overlays over a base fabric of the upper, or may be separate materials sewn to, welded to, fused to, or adhesively attached to the breathable and flexible fabric of the upper. The overlays used in the embodiments described above may be made of thermoplastic elastomers such as thermoplastic polyurethanes. For example, first portion 110 and/or second portion 111 of upper 101 in FIG. 1 may be made of thermoplastic elastomers, such as TPU.

In certain embodiments, an article of footwear has a textile strobel that allows moisture to escape from the bottom of the article of footwear during use, and further allows the interior of the footwear to dry out after use. For example, the strobel may be made of a spacer mesh material. Some embodiments may include soles made of lightweight and flexible materials. In at least some embodiments, the sole may be made of an IU material. The pads at the heel, the big toe region, and the balls of the foot regions may be made of durable elastomers such as thermoplastics, ethylene vinyl acetates, polyurethanes (e.g., polyurethane foam), polyamides or polyolefins.

While various embodiments have been described, the description is intended to be exemplary, rather than limiting and it will be apparent to those of ordinary skill in the art that many more embodiments and implementations are possible that are within the scope of the embodiments. Accordingly, the embodiments are not to be restricted except in light of the attached claims and their equivalents. Also, various modifications and changes may be made within the scope of the attached claims.

What is claimed is:

1. An article of footwear comprising an upper and a sole attached to the upper, wherein the upper comprises:

a toe region, a forefoot region, a midfoot region, and a heel region;

a lateral side and a medial side;

a first portion made of a first material with a first surface that has a first coefficient of friction;

a second portion made of a second material with a second surface that has a second coefficient of friction, wherein the second coefficient of friction is substantially greater than the first coefficient of friction;

a third portion made of a third material with a third surface that has a third coefficient of friction, wherein the second coefficient of friction is greater than the third coefficient of friction, wherein the third coefficient of friction is different than the first coefficient of friction;

an eyestay region comprising a plurality of eyelets, wherein the eyestay region is substantially biased towards the lateral side of the upper;

wherein the second portion is disposed between the first portion and the sole on the medial side;

wherein the third portion is a base layer that extends from the forefoot region to the eyestay region;

wherein the sole comprises:

a first elastomeric pad comprising a plurality of substantially concentric ridges that encircle a central region;

a textile material with a plurality of pads attached to the textile material, wherein the pads comprise downwardly-angled ridges at their outer edges; and wherein the first elastomeric pad comprises a first aperture located in the central region for allowing moisture generated within the article of footwear to escape through the textile material and wherein a portion of the textile material is exposed through the first aperture.

2. The article of footwear of claim 1, wherein the sole further comprises:

a heel region comprising a side portion and a lower portion, the lower portion being associated with a bottom surface of the sole, and the side portion being substantially perpendicular relative to the lower portion;

wherein an upwardly oriented surface includes a surface with a normal component that is oriented at least partially in an upwardly vertical direction, wherein a downwardly oriented surface includes a surface with a normal component that is oriented at least partially in a vertically downward direction; and wherein the first elastomeric pad is disposed partially along the side portion, each of the plurality of substantially concentric ridges located on the side portion including a downwardly oriented surface and an upwardly oriented surface that meet at a peak portion, wherein the peak portion extends outward from the side portion in a substantially horizontal direction.

3. The article of footwear of claim 2, wherein the sole further comprises a forefoot region and wherein the forefoot region of the sole includes a second elastomeric pad.

4. The article of footwear of claim 3, wherein the second elastomeric pad is disposed under a big toe region of the article of footwear.

5. The article of footwear of claim 1, wherein the second material is a polymer overlay over the first material.

6. The article of footwear of claim 1, wherein the second portion is disposed directly adjacent to at least a portion of the sole on both the medial side and the lateral side.

7. The article of footwear of claim 3, wherein the second elastomeric pad comprises a second aperture located in the central region for allowing moisture generated within the article of footwear to escape through the textile layer.

8. The article of footwear of claim 2, wherein the lower portion of the sole is substantially smooth relative to the side portion of the sole.

9. An article of footwear comprising:

a sole comprising a textile layer and a plurality of elastomeric pads;

an upper comprising a first material and a second material, wherein the upper is attached to the sole;

wherein the second material is disposed at a periphery of the upper and wherein the second material is tacky relative to the first material;

wherein at least one of the plurality of elastomeric pads comprises two or more substantially concentric ridges that encircle a central region;

wherein a geometry of each ridge includes a downwardly oriented surface and an upwardly oriented surface that meet at a peak portion of the ridge; and wherein at least one of the plurality of elastomeric pads comprises an aperture located in the central region for allowing moisture generated within the article of footwear to escape through the textile layer, wherein a portion of the textile layer is exposed through the aperture.

10. The article of footwear of claim 9, wherein the sole comprises a heel region and a toe region, and wherein the plurality of elastomeric pads includes an elastomeric pad in the heel region of the sole and an elastomeric pad in the toe region of the sole.

11. The article of footwear of claim 10, wherein the elastomeric pad in the heel region comprises a heel aperture and the elastomeric pad in the toe region comprises a toe aperture.

12. The article of footwear of claim 11, wherein the sole comprises a forefoot region, and wherein the forefoot region further comprises at least one elastomeric pad with ridges angled downwards in the forefoot region of the sole, and wherein a geometry of each of the ridges is configured to provide unidirectional traction to the article of footwear.

13. The article of footwear of claim 9, wherein the upper comprises an ankle opening and an eyestay region extending down from the ankle opening towards a lateral side of the upper, and wherein one or more reinforcing strips extend between the eyestay region and a lower periphery of the upper, wherein each reinforcing strip is configured to resist stretching in a longitudinal direction, wherein the longitudinal direction extends lengthwise between a heel region and a forefoot region of the wrestling shoe.

14. The article of footwear of claim 9, wherein the textile layer comprises spacer mesh material.

15. A wrestling shoe comprising:

an upper comprised of a first material and a second material, the second material being tacky compared to the first material;

a sole comprised of a textile strobel and a plurality of pads, the plurality of pads including a toe pad in a toe region of the sole and a heel pad in a heel region of the sole;

wherein the toe pad comprises a plurality of substantially concentric ridges that encircle a central region;

wherein the toe region includes a lower portion and a side portion, wherein the lower portion is substantially perpendicular relative to the side portion, wherein the lower portion and the side portion are substantially continuous;

wherein the toe pad comprises a toe pad aperture located in the central region for allowing moisture generated within the article of footwear to escape through the textile layer;

wherein a coefficient of friction of the second material is at least ten times greater than a coefficient of friction of the first material;

wherein the upper also comprises an eyestay region biased towards the lateral side of the upper; and wherein the toe pad comprises a first plurality of downwardly-angled ridges, and wherein the heel pad comprises a second plurality of downwardly-angled ridges, wherein the first plurality of downwardly-angled ridges are associated with the side portion of the big toe region.

16. The wrestling shoe of claim 15, wherein the heel pad comprises a heel pad aperture.

17. The wrestling shoe of claim 16, further comprising an ankle strap that passes around an ankle opening within an outer layer of the ankle opening.

18. The wrestling shoe of claim 15, wherein the toe pad is an elastomeric toe pad and the heel pad is an elastomeric heel pad.

19. The wrestling shoe of claim 15, wherein the first material is one of a woven material and a knitted material.

20. The wrestling shoe of claim 15, wherein the first plurality of downwardly-angled ridges in the toe pad and the second plurality of downwardly-angled ridges in the heel pad are configured to dig into a wrestling mat when pushed into the wrestling mat from a first direction and to slide across the wrestling mat when dragged in a second direction.

* * * * *